US010369683B2

(12) United States Patent
Umbrell

(10) Patent No.: US 10,369,683 B2
(45) **Date of Patent: *Aug. 6, 2019**

(54) BUFFING PAD CENTERING SYSTEM

(71) Applicant: BUFF AND SHINE MANUFACTURING, INC., Rancho Dominguez, CA (US)

(72) Inventor: Richard Umbrell, Rancho Palos Verdes, CA (US)

(73) Assignee: Buff and Shine Mfg. Inc, Rancho Dominguez, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/071,408

(22) Filed: Nov. 4, 2013

(65) Prior Publication Data

US 2014/0127981 A1 May 8, 2014

Related U.S. Application Data

(63) Continuation of application No. 12/518,360, filed as application No. PCT/US2007/087311 on Dec. 12, 2007, now Pat. No. 8,572,797.

(60) Provisional application No. 60/875,022, filed on Dec. 14, 2006.

(51) Int. Cl.

| | |
|---|---|
| ***A47L 11/14*** | (2006.01) |
| ***B24B 29/00*** | (2006.01) |
| ***B24D 13/14*** | (2006.01) |
| ***A47L 11/40*** | (2006.01) |
| ***A47L 11/162*** | (2006.01) |
| ***B24D 13/20*** | (2006.01) |

(52) U.S. Cl.

CPC ..... *B24D 13/14* (2013.01); *A47L 11/14* (2013.01); *A47L 11/162* (2013.01); *A47L 11/4038* (2013.01); *B24B 29/00* (2013.01); *B24D 13/20* (2013.01); *Y10T 29/49826* (2015.01)

(58) Field of Classification Search

CPC ..... A47L 11/162; B24B 29/00

USPC ..... 15/98, 180, 230, 230.12, 230.19

See application file for complete search history.

(56) References Cited

U.S. PATENT DOCUMENTS

| | | | | |
|---|---|---|---|---|
| 4,188,682 | A * | 2/1980 | Burglin et al. | 15/97.1 |
| 4,907,313 | A * | 3/1990 | Roeker et al. | 15/98 |
| 5,138,735 | A * | 8/1992 | Kusz et al. | 15/97.1 |
| 5,150,546 | A * | 9/1992 | Tucker | 451/342 |
| 6,081,959 | A * | 7/2000 | Umbrell | 15/230.19 |
| 6,378,157 | B1 * | 4/2002 | Kosla et al. | 15/230 |
| 6,523,214 | B1 * | 2/2003 | Kaiser | 15/230 |

* cited by examiner

*Primary Examiner* — Randall E Chin

(74) *Attorney, Agent, or Firm* — Fitzsimmons IP Law

(57) ABSTRACT

In general, a Buffing Pad Centering System ("BPCS") for centering a back plate having an edge and a front surface is described. In an example of an implementation of the BPCS, the BPCS may include a centering ring having a top boundary and a bottom boundary and a buffing pad attached to the bottom boundary of the centering ring, where the centering ring is centered on the buffing pad. The centering ring may include a cylindrical vertical member extending between the top boundary and bottom boundary, where the cylindrical vertical member has an inner cylindrical surface and an outer cylindrical surface, and where the inner cylindrical surface is capable of snuggly receiving the back plate.

20 Claims, 16 Drawing Sheets

BUFFING PAD CENTERING SYSTEM

CROSS REFERENCE TO RELATED APPLICATIONS

This application is a continuation of U.S. Non-Provisional application Ser. No. 12/518,360, entitled "BUFFING PAD CENTERING SYSTEM," filed Dec. 16, 2009, issued as U.S. Pat. No. 8,572,797 on Nov. 5, 2013, which application claims priority under 35 U.S.C. Section 365 to PCT Application Serial No. PCT/US2007/87311, entitled "BUFFING PAD CENTERING SYSTEM," filed Dec. 12, 2007, which application claims priority under 35 U.S.C. Section 119(e) to U.S. Provisional Application Ser. No. 60/875,022, entitled "PAD RING," filed Dec. 14, 2006, all of which applications are incorporated into this application by reference in their entireties.

BACKGROUND OF THE INVENTION

1. Field of the Invention

The present invention relates, in general, to rotating and/or orbiting buffing and/or polishing devices and in particular to centering devices for centering a back plate to a buffing and/or polishing pad.

2. Related Art

Buffing and/or polishing devices (also known as "buffers" or "polishers" are all herein referred to as "buffing devices") are devices having a soft absorbent surface known as a buffing or polishing pad or material (herein referred to as a "buffing pad"), by which polishing material is applied, and utilized for polishing a surface using friction. Buffing devices vary in type from non-powered hand-held devices to buffing devices capable of being utilized with powered head-units (generally known as a "polisher power tool"). Buffing devices capable of being utilized with powered head-units include rotary and random orbital buffing devices.

Rotary buffing devices are buffing devices capable of having their respective buffing pads move in a rotational motion (i.e., spinning) Random orbital buffing devices are buffing devices that are capable of having their respective buffing pads move in a combined spinning and orbital motion.

One of the latest generations of known rotary and random orbital buffing devices include a buffing pad attached to a buffing device back plate as shown in FIGS. 1A through 1C. The buffing device is capable of being connected to a powered head-unit that physically connects to the back plate.

In FIG. 1A, a perspective view is shown of a buffing device back plate (simply referred to as the "back plate") 100 separated from a buffing pad 102. The back plate 100 may have back surface 104, connection member 106, optional connection rod 108, edge 110, and front surface (not shown). The buffing pad 102 may have an outer surface 112, back surface 114, inner surface 116, and inner wall surface 118. In FIG. 1B, a perspective view is shown of the both the back plate 100 and buffing pad 102 physically connected together. Similarly, in FIG. 1C, a side view is shown of the both the back plate 100 and buffing pad 102 physically connected together along the front surface 120 of the back plate 100 and the inner surface 116 of the buffing pad 102. From FIG. 1C, it is appreciated that the edge 110 of the back plate 100 is resting against the inner surface 116 and inner wall surface 118 of the buffing pad 102 at a contact point 122.

Typically, the back surface 104 and connection member 106 of the back plate 100 are constructed of a hard material such as metal, wood, plastic, epoxy resin, polyurethane, or other rigid materials. The optional connection rod 108 may be a threaded rod made of hard material that is capable of physically engaging the buffing device powered head-unit (not shown). If no optional connection rod 108 is utilized, the connection member 106 may include a threaded shaft (not shown) within the connection member 106 that is capable of physically engaging the buffing device powered head-unit with a threaded rod.

Generally, the outer surface 112 of the buffing pad 102 are constructed of soft or semi-soft material for use in polishing a surface. The material may include foam, polyurethane, wool, or other material used for polishing surfaces. The inner surface 116 and inner wall surface 118 of the buffing pad 102 define the surfaces of a cavity 124 within the buffing pad 102. The cavity 124 generally assists in roughly centering the back plate 100 to the buffing pad 102.

Within this cavity 124, the inner surface 116 and inner wall surface 118 is generally coated with a hard material (not shown) such as plastic, epoxy resin, or polyurethane. As a result of applying the coating material on the buffing pad 102, the inner wall surface 118 may be curved inwards towards the inner surface 116 resulting in the cavity 124 having a curved-up "cup" type shape. The reason for this cup shape is that the coating process usually involves a pressure lamination molding process that would result in unwanted "hot spots" on the buffing pad 102 if the inner wall surface 118 were molded at 90 degrees from the inner surface 116.

In addition to the coating material, the inner surface 116 may include fabric hook-and-loop fasteners (also known as "hook and loop," "burr," and "touch" fasteners and generally identified by the registered trademark brand name VELCRO® herein referred to as "hook-and-loop fabric") attached to the inner surface 116. As an example, the inner surface 116 have attached the loop-side of the hook-and-loop fabric and the front surface 120 have attached the hook-side of the hook-and-loop fabric. The hook-and-loop fabric may be utilized to physically attach the front surface 120 of the back plate 100 to the inner surface 116 of the buffing pad 102.

Unfortunately, these types of known rotary and random orbital buffing devices have problems relating to the difficulties in centering the front surface 120 of the back plate 100 with the inner surface 116 of the buffing pad 102. These difficulties result from the lack of an accurate centering system between the back plate 100 and buffing pad 102 and a general lack of tolerance control on the size and shape of the cavity 124.

Generally, these types of known rotary and random orbital buffing devices have backing plates 100 that have to be produced to fit the curved shaped cavity 124 of the buffing pad 102. This fit includes having the edge 110 of the back plate 102 placed sufficiently deep in the cavity 124 so as to prevent the edge 110 from slipping out of the cavity 124 and hitting an external material (not shown) to be polished. Unfortunately, this fit does not include accurate centering of the back plate 100 within the cavity 124, which typically results in unwanted vibration while in operation.

In general, spinning objects should be centered with high precision to prevent unwanted vibration because unwanted vibration causes, as an example, operator fatigue and annoyance, undesirable buffing results, premature wear of the bearings of the powered head-unit, potential damage to the buffing pad 100, and other undesirable effects. In addition, objects moving with combined rotational and orbital motion experience violent forces that can significantly amplify the problems associated with uncentered spinning objects. This motion places heavy stress on the hook-and-loop fabric holding the buffing pad 102 to the back plate 100. Typically this motion is so violent that it can shear the loops on the inner surface 116 of the buffing pad 100 and create heat that is capable of loosing the adhesives that typically attach the hook-and-loop fabric on to the buffing pad 100.

As mentioned above, the cavity 124 is capable of roughly centering the back plate 100 to the buffing pad 102 and preventing the back plate 100 from hitting any external surface (not shown) that is to be buffed. Unfortunately, as a result of the violet motion associated with an orbital buffing device, the use of a recessed soft material (such as, for example, foam) within the cavity 124 results in the edge 110 of the back plate 100 acting as cutting blade within the cavity 124. As such, the edge 110 of the back plate 100 will eventually cut into the inner wall surface 118 at the contact point 122 and destroy the buffing pad 102 prematurely.

Therefore, there is a need for system capable of solving the above described problems with known buffing pads.

SUMMARY

In general, a Buffing Pad Centering System ("BPCS") for centering a back plate having an edge and a front surface is described. In an example of an implementation of the BPCS, the BPCS may include a centering ring having a top boundary and a bottom boundary and a buffing pad attached to the bottom boundary of the centering ring, where the centering ring is centered on the buffing pad. The centering ring may include a cylindrical vertical member extending between the top boundary and bottom boundary, where the cylindrical vertical member has an inner cylindrical surface and an outer cylindrical surface, and where the inner cylindrical surface is capable of snuggly receiving the back plate.

In another example of implementation of the BPCS, the BPCS may a centering ring including, a cylindrical vertical member, and a bottom projecting member connected to the cylindrical vertical member. The bottom projecting member projects out from the cylindrical vertical member at approximately 90 degrees and is capable of supporting the edge of the back plate. The cylindrical vertical member is capable of tightly receiving the back plate and the bottom projecting member of the centering ring is capable of being centered and attached to the buffing pad.

Also described is a method of manufacturing a Buffing Pad Centering System ("BPCS") for centering a back plate having an edge on a buffing pad. The method may include centering a centering ring having a top boundary and a bottom boundary on a buffing pad and attaching the bottom boundary of the centering ring to the buffing pad.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. In the figures, like reference numerals designate corresponding parts throughout the different views.

DETAILED DESCRIPTION

In the following description of the preferred and various alternative embodiments, reference is made to the accompanying drawings that form a part hereof, and in which is shown by way of illustration a specific embodiment in which the invention may be practiced. It is to be understood that other embodiments may be utilized and structural changes may be made without departing from the spirit and scope of this invention.

In the following description of the preferred and various alternative embodiments, reference is made to the accompanying drawings that form a part hereof, and in which is shown by way of illustration a specific embodiment in which the invention may be practiced. It is to be understood that other embodiments may be utilized and structural changes may be made without departing from the spirit and scope of this invention.

Figure 1B:
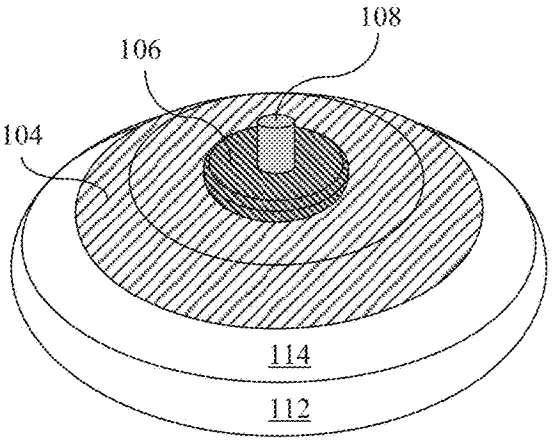
FIG. 1B (Prior Art)
FIG. 1B is a perspective view of the both the back plate and buffing pad, shown in FIG. 1A, physically connected together.
Figure 1A:
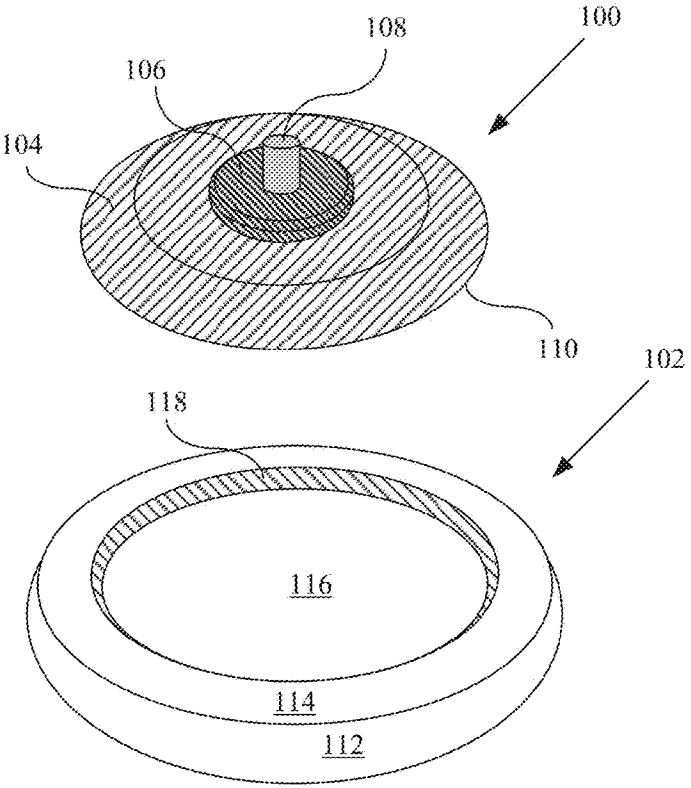
FIG. 1A (Prior Art)
FIG. 1A is a perspective view of a known buffing device back plate separated from a buffing device buffing pad.
Figure 1C:
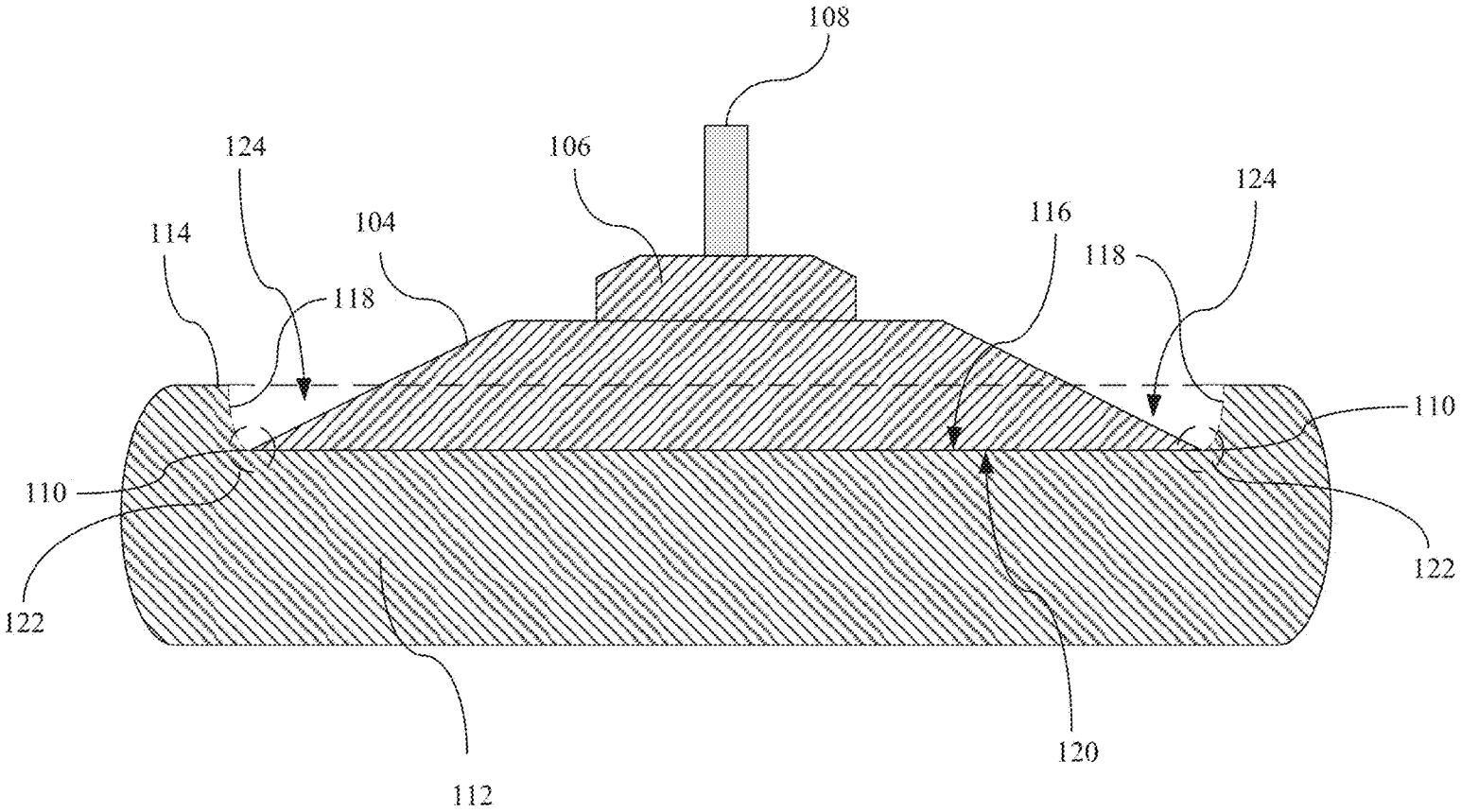
FIG. 1C (Prior Art)
FIG. 1C is a side view of the both the back plate and buffing pad, shown in FIG. 1A, physically connected together along the front surface of the back plate and the inner surface of the buffing pad.
Figure 2B:
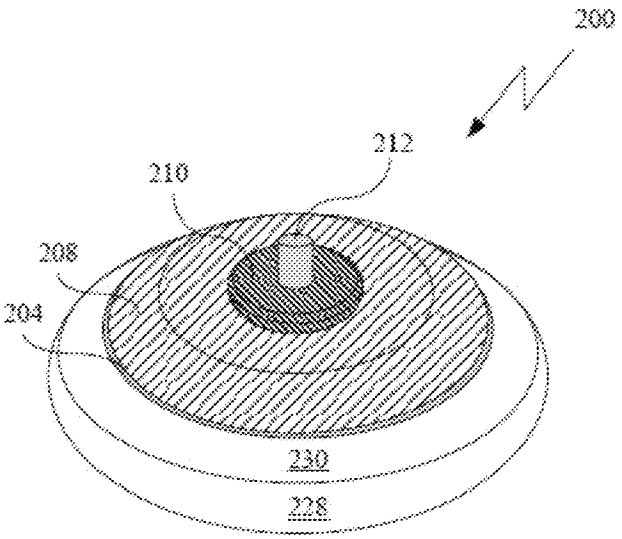
FIG. 2B is a perspective view of a back plate, centering ring, and buffing pad, shown in BPCS of FIG. 2A, physically connected together in accordance with the invention.
Figure 2A:
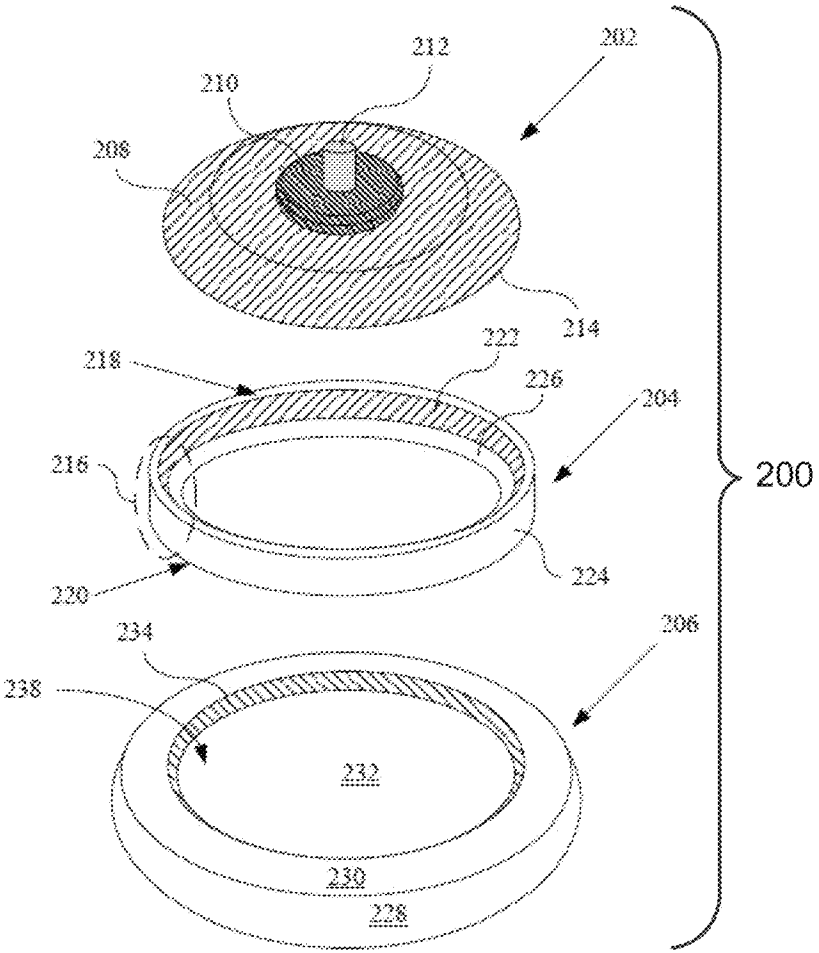
FIG. 2A is an exploded perspective view of an example of an implementation of a Buffing Pad Centering System ("BPCS") in accordance with the invention.
Figure 2C:
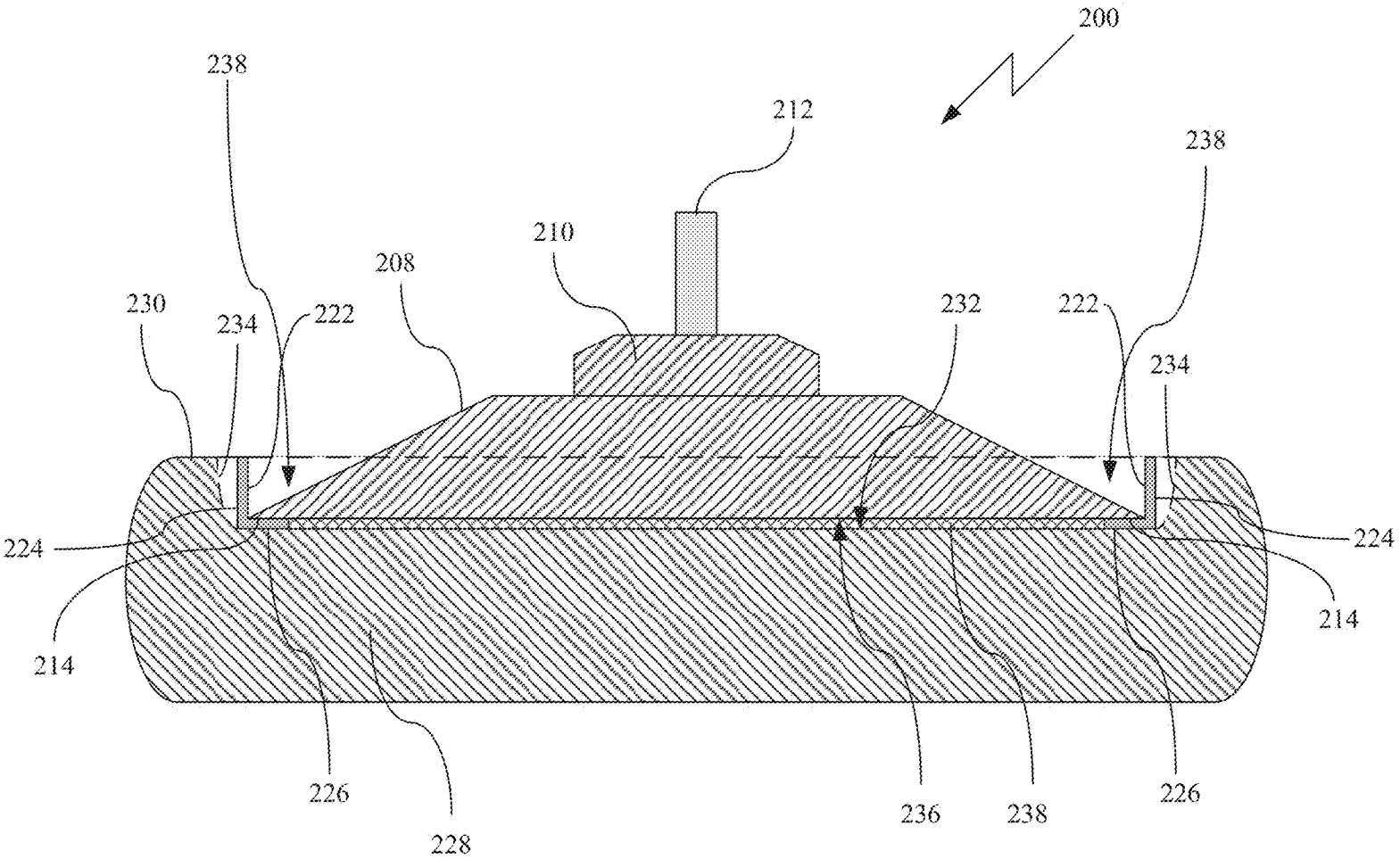
FIG. 2C is a side view of the BPCS, of FIG. 2A, with the back plate, centering ring, and buffing pad physically connected together along a front surface of the back plate and an inner surface of the buffing pad in accordance with the invention.

In general, a Buffing Pad Centering System ("BPCS") for centering a back plate having an edge and a front surface is described. As an example of an implementation of the BPCS, the BPCS may include a centering ring having a top boundary and a bottom boundary and a buffing pad attached to the bottom boundary of the centering ring, where the centering ring is centered on the buffing pad. The centering ring may include a cylindrical vertical member extending between the top boundary and bottom boundary, where the cylindrical vertical member has an inner cylindrical surface and an outer cylindrical surface, and where the inner cylindrical surface is capable of snuggly receiving the back plate. FIGS. 2A through 2C show an example of an implementation of a BPCS 200 capable of being connected to a powered head-unit (not shown) that physically connects to a buffing device back plate (simply referred to as the "back plate") 202. In this example, the back plate 202 is capable of attaching to a buffing pad 206 through a centering ring 204, where the buffing pad 206 has a cavity 238 in the back of the buffing pad 206 and where the centering ring 204 fits into the cavity 238 and is capable of snuggly receiving the back plate 202.

In FIG. 2A, an exploded perspective view of an example of an implementation of the BPCS 200 is shown in accordance with the invention. A back plate 202 may be connected to the BPCS 200. The BPCS 200 may include the centering ring 204 and buffing pad 206. The back plate 202 may have back surface 208, connection member 210, optional connection rod 212, edge 214, and front surface (not shown). The centering ring 204 may have a cylindrical vertical member 216. The centering ring 204 may have a top boundary 218 and a bottom boundary 220 where the cylindrical vertical member 216 extends between the top boundary 218 and bottom boundary 220. The cylindrical vertical member 216 may include an inner cylindrical surface 222 and an outer cylindrical surface 224. The inner cylindrical surface 222 is capable of snuggly receiving the back plate 202. The centering ring 204 includes a bottom projecting member 226, wherein the bottom projecting member 226 projects out from the inner cylindrical surface 222 of the cylindrical vertical member 216 at approximately 90 degrees to form an inner bottom ledge 226 that is capable of supporting the edge 214 of the back plate 202. The buffing pad 206 may have an outer surface 228, back surface 230, inner surface 232, and inner wall surface 234.

In FIG. 2B, a perspective view is shown of the BPCS 200 with the back plate 202, centering ring 204, and buffing pad 206 physically connected together. Similarly, in FIG. 2C, a side view is shown of the BPCS 200 with the back plate 202, centering ring 204, and buffing pad 206 physically connected together along the front surface 236 of the back plate 202 and the inner surface 232 of the buffing pad 206. From FIG. 2C, it is appreciated that the front surface 236 of the back plate 202 is attached to the inner surface 232 of the buffing pad 206 utilizing an attaching means 238. The attaching means 238 may be fabric hook-and-loop fasteners (also known as "hook and loop," "burr," and "touch" fasteners and generally identified by the registered trademark brand name VELCRO® herein referred to as "hook-and-loop fabric").

It is also appreciated that the bottom projecting member 226 may be attached to the inner surface 232 utilizing adhesive. Similarly, the hook-and-loop fabric 238 maybe be attached to both the front surface 236 and inner surface 232 utilizing adhesive (i.e., as an example, a loop-side fabric (not shown) of the hook-and-loop fabric 238 may be bonded to the inner surface 232, while a hook-side fabric (not shown) of the hook-and-loop fabric 238 may be bonded to the front surface 236, or vise-versa).

Typically, the back surface 208 and connection member 210 of the back plate 202 are constructed of a hard material such as metal, wood, plastic, epoxy resin, polyurethane, or other rigid materials. The optional connection rod 212 may be a threaded rod made of hard material that is capable of physically engaging the buffing device powered head-unit (not shown). If no optional connection rod 212 is utilized, the connection member 210 may include a threaded shaft (not shown) within the connection member 210 that is capable of physically engaging the powered head-unit with a threaded rod (not shown).

Generally, the outer surface 228 of the buffing pad 206 are constructed of soft or semi-soft material for use in polishing a surface. The material may include foam, polyurethane, cloth, wool, or other material used for polishing surfaces. The inner surface 232 and inner wall surface 234 of the buffing pad 206 define the surfaces of the cavity 238 within the buffing pad 206.

Figure 3B:
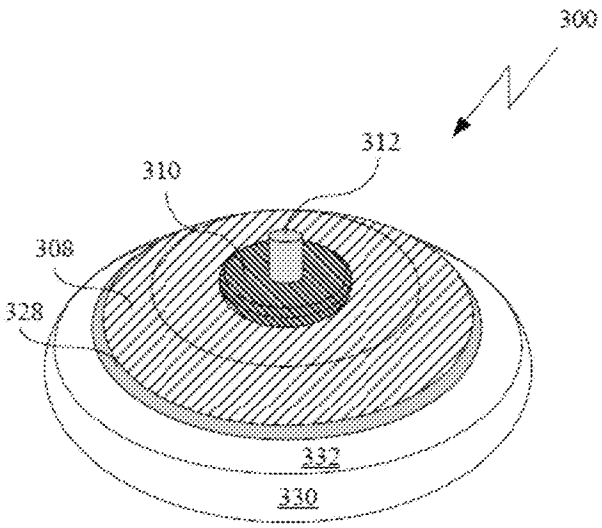
FIG. 3B is a perspective view of the BPCS, shown in FIG. 3A, with a back plate, centering ring, and buffing pad physically connected together.
Figure 3A:
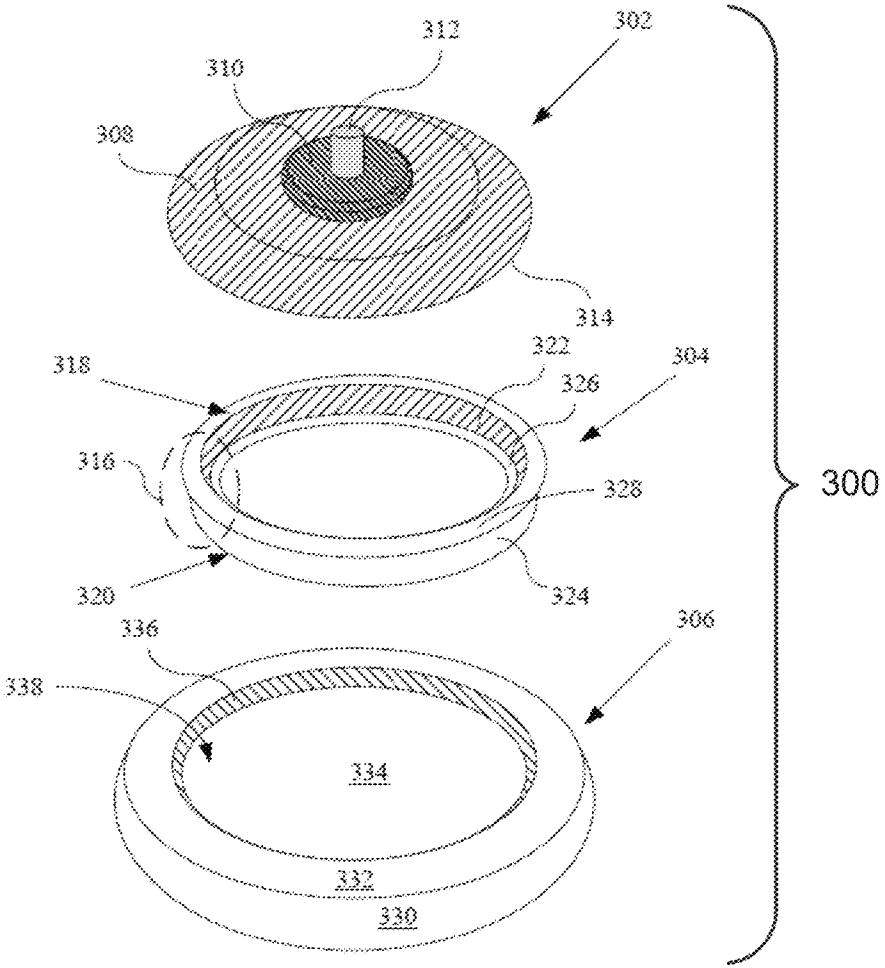
FIG. 3A is an exploded perspective view of another example of an implementation of a BPCS in accordance with the invention.
Figure 3C:
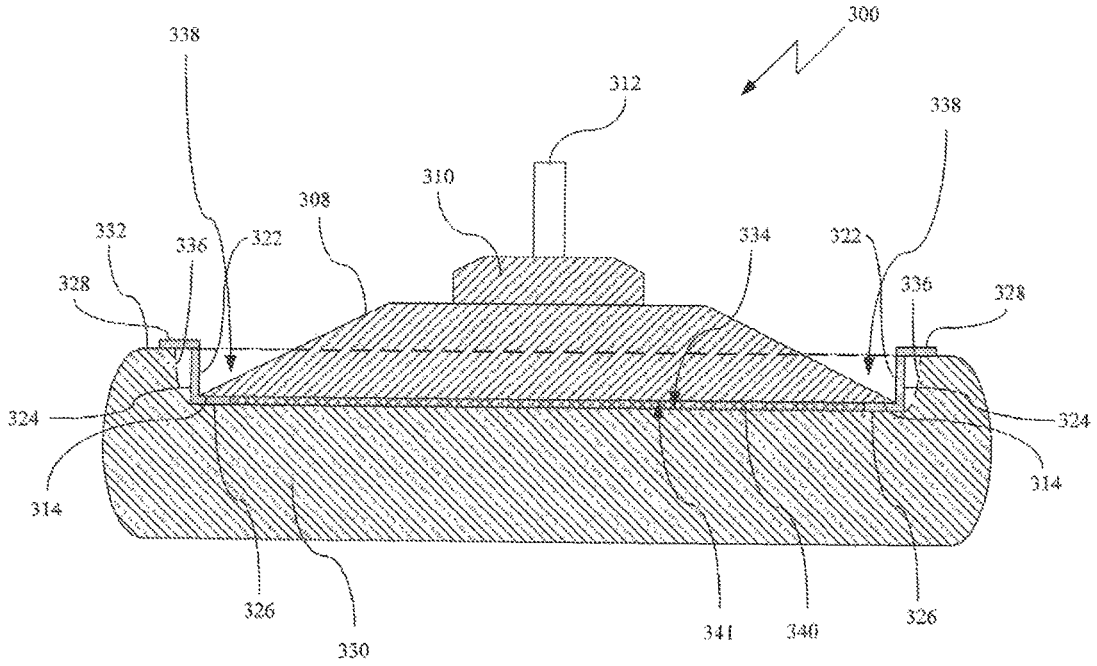
FIG. 3C is a side view of the BPCS, of FIG. 3A, with the back plate, centering ring, and buffing pad physically connected together along a front surface of the back plate and an inner surface of the buffing pad in accordance with the invention.

FIGS. 3A through 3C show another example of an implementation of a BPCS 300 capable of being connected to a powered head-unit (not shown) that physically connects to the back plate 302. In this example, similar to the example described in FIGS. 2A through 2C, the back plate 302 is capable of attaching to a buffing pad 306 through a centering ring 304, where the buffing pad 306 has a cavity 338 in the back of the buffing pad 306 and where the centering ring 304 fits into the cavity 338 and is capable of snuggly receiving the back plate 302.

In FIG. 3A, an exploded perspective view of an example of an implementation of a BPCS 300 is shown in accordance with the invention. A back plate 302 may be connected to the BPCS 300 and the BPCS 300 may include the centering ring 304 and buffing pad 306. The back plate 302 may have back surface 308, connection member 310, optional connection rod 312, edge 314, and front surface (not shown). The centering ring 304 may have a cylindrical vertical member 316. The centering ring 304 may have a top boundary 318 and a bottom boundary 320 where the cylindrical vertical member 316 extends between the top boundary 318 and bottom boundary 320. The cylindrical vertical member 316 may include an inner cylindrical surface 322 and an outer cylindrical surface 324. The inner cylindrical surface 322 is capable of snuggly receiving the back plate 302. The centering ring 304 includes a bottom projecting member 326, wherein the bottom projecting member 326 projects out from the inner cylindrical surface 322 of the cylindrical vertical member 316 at approximately 90 degrees to form an inner bottom ledge 326 that is capable of supporting the edge 314 of the back plate 302. In this example, the top boundary 318 of the centering ring 304 includes a top projecting member 328, wherein the top projecting member 328 projects out from the outer cylindrical surface 324 of cylindrical vertical member 316 at approximately 90 degrees. The buffing pad 306 may have an outer surface 330, back surface 332, inner surface 334, and inner wall surface 336.

In FIG. 3B, a perspective view is shown of the BPCS 300 with the back plate 302, centering ring 304, and buffing pad 306 physically connected together. Similarly, in FIG. 3C, a side view is shown of the BPCS 300 with the back plate 302, centering ring 304, and buffing pad 306 physically connected together along the front surface 341 of the back plate 302 and the inner surface 334 of the buffing pad 306. From FIG. 3C, it is appreciated that the front surface 341 of the back plate 302 is attached to the inner surface 334 of the buffing pad 306 utilizing an attaching means 340. The attaching means 340 may be a hook-and-loop fabric.

Again, it is also appreciated that the bottom projecting member 326 may be attached to the inner surface 334 utilizing adhesive. Similarly, the hook-and-loop fabric 340 maybe be attached to both the front surface 341 and inner surface 334 utilizing adhesive (i.e., as an example, a loop-side fabric (not shown) of the hook-and-loop fabric 340 may be bonded to the inner surface 334, while a hook-side fabric (not shown) of the hook-and-loop fabric 340 may be bonded to the front surface 341, or vise-versa).

Typically, each of the back surface 308 and connection member 310 of the back plate 302 is constructed of a hard material such as metal, wood, plastic, epoxy resin, polyurethane, or other rigid materials. The optional connection rod 312 may be a threaded rod made of hard material that is capable of physically engaging the buffing device powered head-unit (not shown). If no optional connection rod 312 is utilized, the connection member 310 may include a threaded shaft (not shown) within the connection member 310 that is capable of physically engaging the powered head-unit with a threaded rod (not shown).

Generally, the outer surface 330 of the buffing pad 306 are constructed of soft or semi-soft material for use in polishing a surface. The material may include foam, polyurethane, cloth, wool, or other material used for polishing surfaces. The inner surface 334 and inner wall surface 336 of the buffing pad 306 define the surfaces of the cavity 338 within the buffing pad 306.

Figure 4B:
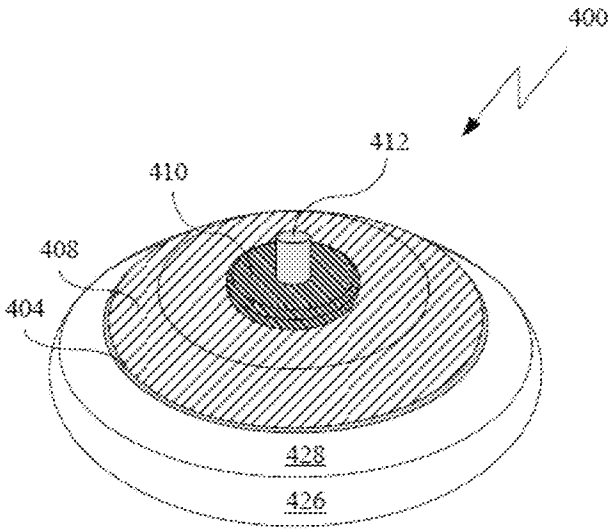
FIG. 4B is a perspective view of the BPCS, of FIG. 4A, with a back plate, centering ring, and buffing pad physically connected together in accordance with the invention.
Figure 4A:
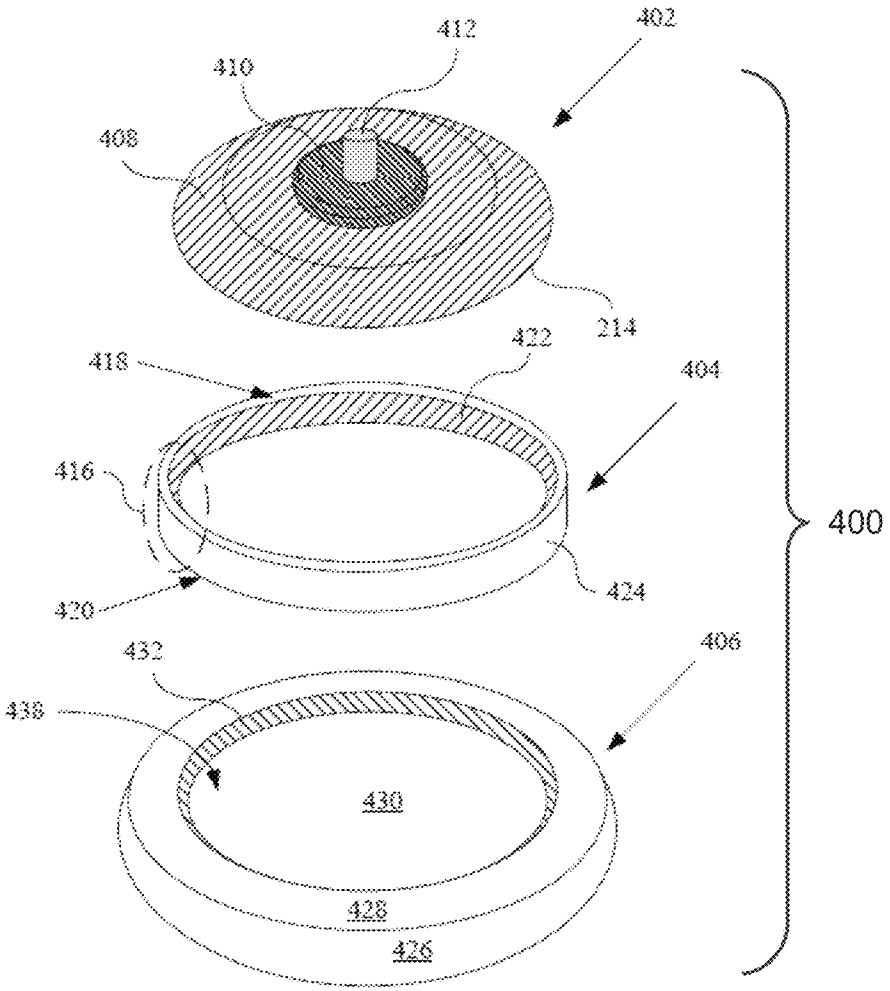
FIG. 4A is an exploded perspective view of another example of an implementation of the BPCS in accordance with the invention.
Figure 4C:
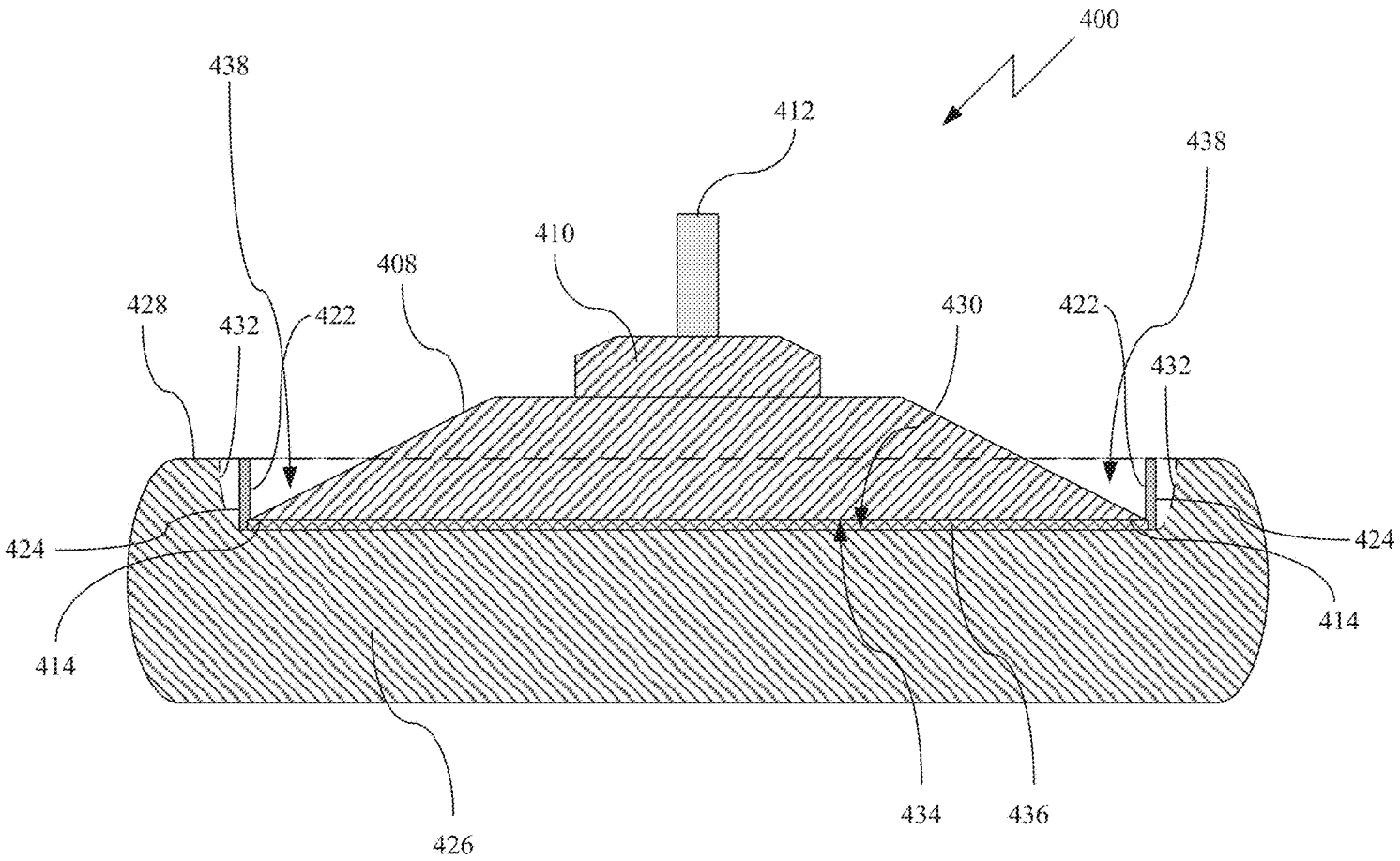
FIG. 4C is a side view of the BPCS, of FIG. 4A, with a back plate, centering ring, and buffing pad physically connected together along a front surface of the back plate and an inner surface of the buffing pad in accordance with the invention.

FIGS. 4A through 4C show yet another example of an implementation of a BPCS 400 capable of being connected to a powered head-unit (not shown) that physically connects to the back plate 402. In this example, again similar to the example described in FIGS. 2A through 2C, the back plate 402 is capable of attaching to a buffing pad 406 through a centering ring 404, where the buffing pad 406 has a cavity 438 in the back of the buffing pad 406 and where the centering ring 404 fits into the cavity 438 and is capable of snuggly receiving the back plate 402.

In FIG. 4A, an exploded perspective view of an example of an implementation of the BPCS 400 is shown in accordance with the invention. Again, a back plate 402 may be connected to the BPCS 400 and the BPCS 400 may include the centering ring 404 and buffing pad 406. The back plate 402 may have back surface 408, connection member 410, optional connection rod 412, edge 414, and front surface (not shown). The centering ring 404 may have a cylindrical vertical member 416. The centering ring 404 may have a top boundary 418 and a bottom boundary 420 where the cylindrical vertical member 416 extends between the top boundary 418 and bottom boundary 420. The cylindrical vertical member 416 may include an inner cylindrical surface 422 and an outer cylindrical surface 424. The inner cylindrical surface 422 is capable of snuggly receiving the back plate 402. The buffing pad 406 may have an outer surface 426, back surface 428, inner surface 430, and inner wall surface 432.

In FIG. 4B, a perspective view is shown of the BPCS 400 with the back plate 402, centering ring 404, and buffing pad 406 physically connected together. Similarly, in FIG. 4C, a side view is shown of the BPCS 400 with the back plate 402, centering ring 404, and buffing pad 406 physically connected together along the front surface 434 of the back plate 402 and the inner surface 430 of the buffing pad 406. From FIG. 4C, it is appreciated that the front surface 434 of the back plate 402 is attached to the inner surface 430 of the buffing pad 406 utilizing an attaching means 436. The attaching means 436 may be a hook-and-loop fabric.

Again, it is also appreciated that the bottom boundary 420 may be attached to the inner surface 430 utilizing adhesive. Similarly, the hook-and-loop fabric 436 maybe be attached to both the front surface 434 and inner surface 430 utilizing adhesive (i.e., as an example, a loop-side fabric (not shown) of the hook-and-loop fabric 436 may be bonded to the inner surface 430, while a hook-side fabric (not shown) of the hook-and-loop fabric 436 may be bonded to the front surface 434, or vise-versa).

Yet again typically, the back surface 408 and connection member 410 of the back plate 402 are constructed of a hard material such as metal, wood, plastic, epoxy resin, polyurethane, or other rigid materials. The optional connection rod 412 may be a threaded rod made of hard material that is capable of physically engaging the buffing device powered head-unit (not shown). If no optional connection rod 412 is utilized, the connection member 410 may include a threaded shaft (not shown) within the connection member 410 that is capable of physically engaging the powered head-unit with a threaded rod (not shown).

Generally, the outer surface 426 of the buffing pad 406 are constructed of soft or semi-soft material for use in polishing a surface. The material may include foam, polyurethane, cloth, wool, or other material used for polishing surfaces. The inner surface 430 and inner wall surface 432 of the buffing pad 406 define the surfaces of the cavity 438 within the buffing pad 406.

The examples in FIGS. 2A through 4C show implementations of the BPCS in buffing pads that include cavities where the respective type of centering ring may rest inside the cavities. Other examples of different implementations of the BPCS may include buffing pads that do not have cavities. In these implementations the centering ring may be attached to the back surface of the buffing pad. Moreover, other examples of different implementations of the BPCS may also include buffing pads that have cavities within soft materials such as, for example, cloth or wool. As an example, FIGS. 5 through 7 show different implementations of BPCSs with their respective centering rings located on the back surfaces of the buffing pads that do not have cavities, while FIGS. 8 through 11 show different implementations of BPCSs with their respective centering rings located within cavities of buffing pads that utilize soft materials such as, for example, cloth or wool.

Figure 5:
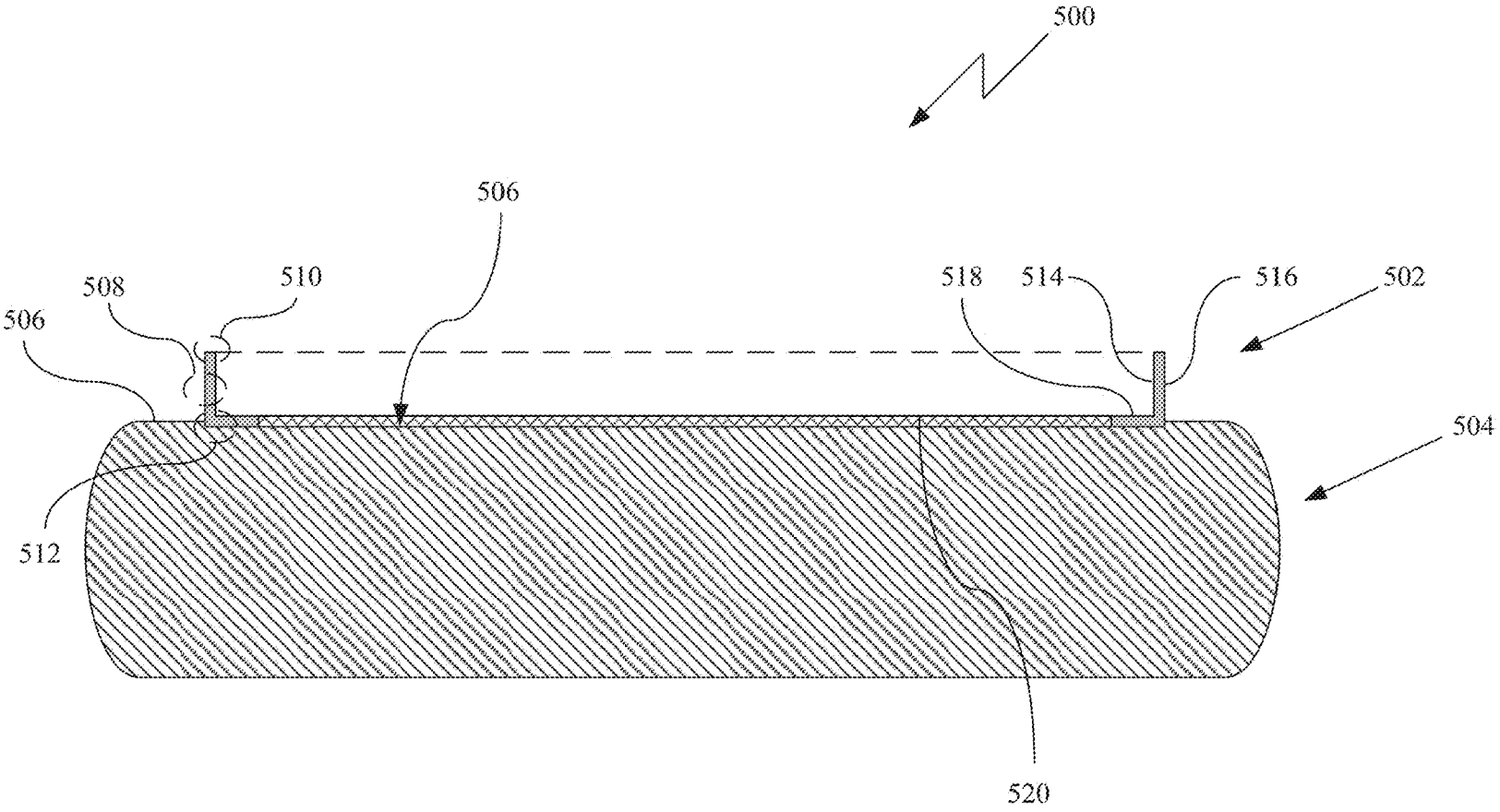
FIG. 5 is a side view of yet another example of an implementation of a BPCS in accordance with the invention.

In FIG. 5, a side view of an example of an implementation of a BPCS 500 is shown in accordance with the invention. The BPCS 500 may include a centering ring 502 and a buffing pad 504. The centering ring 502 is attached to the back surface 506 of the buffing pad 504. Similar to the centering ring 204 described in FIG. 2A through 2C, the centering ring 502 may have a cylindrical vertical member 508 and a top boundary 510 and a bottom boundary 512 where the cylindrical vertical member 508 extends between the top boundary 510 and bottom boundary 512. The cylindrical vertical member 508 may include an inner cylindrical surface 514 and an outer cylindrical surface 516. The inner cylindrical surface 514 is capable of snuggly receiving a back plate (not shown). The centering ring 502 includes a bottom projecting member 518, wherein the bottom projecting member 518 projects out from the inner cylindrical surface 514 of the cylindrical vertical member 508 at approximately 90 degrees to form an inner bottom ledge 518 that is capable of supporting the edge of the back plate.

In FIG. 5, it is appreciated that the front surface (not shown) of the back plate is attached to the back surface 506 of the buffing pad 504 utilizing an attaching means 520. The attaching means 520 may be a hook-and-loop fabric. Additionally, it is also appreciated that the bottom projecting member 518 may be attached to the back surface 506 utilizing adhesive. Similarly, the hook-and-loop fabric 520 maybe be attached to the back surface 506 utilizing adhesive. As an example, a loop-side fabric of the hook-and-loop fabric 520 may be bonded to the back surface 506, while a hook-side fabric (not shown) of the hook-and-loop fabric 520 may be bonded to the front surface of the back plate, or vise-versa.

Figure 6:
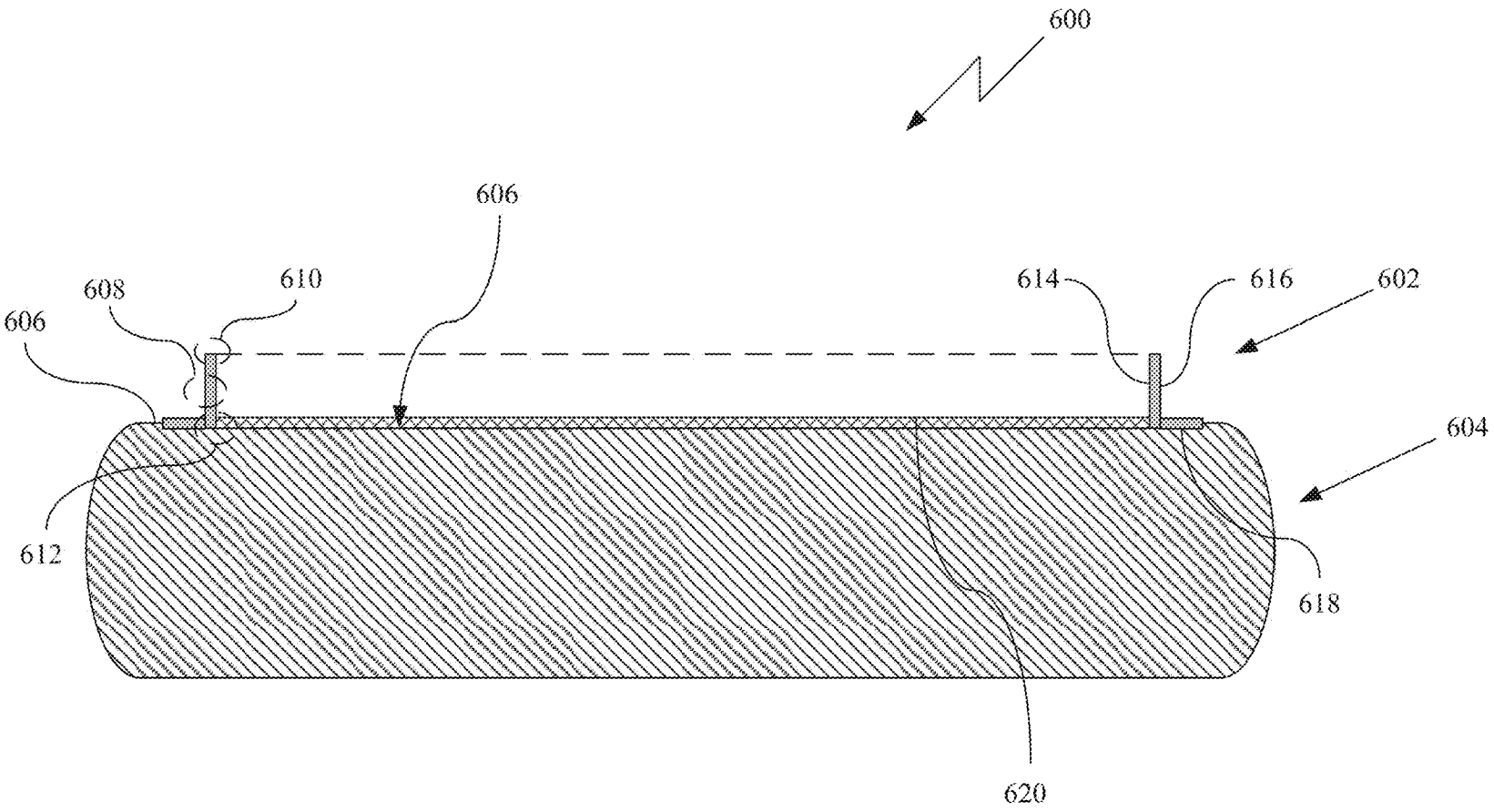
In FIG. 6, a side view of another example of an implementation of a BPCS is shown in accordance with the invention.
Figure 7:
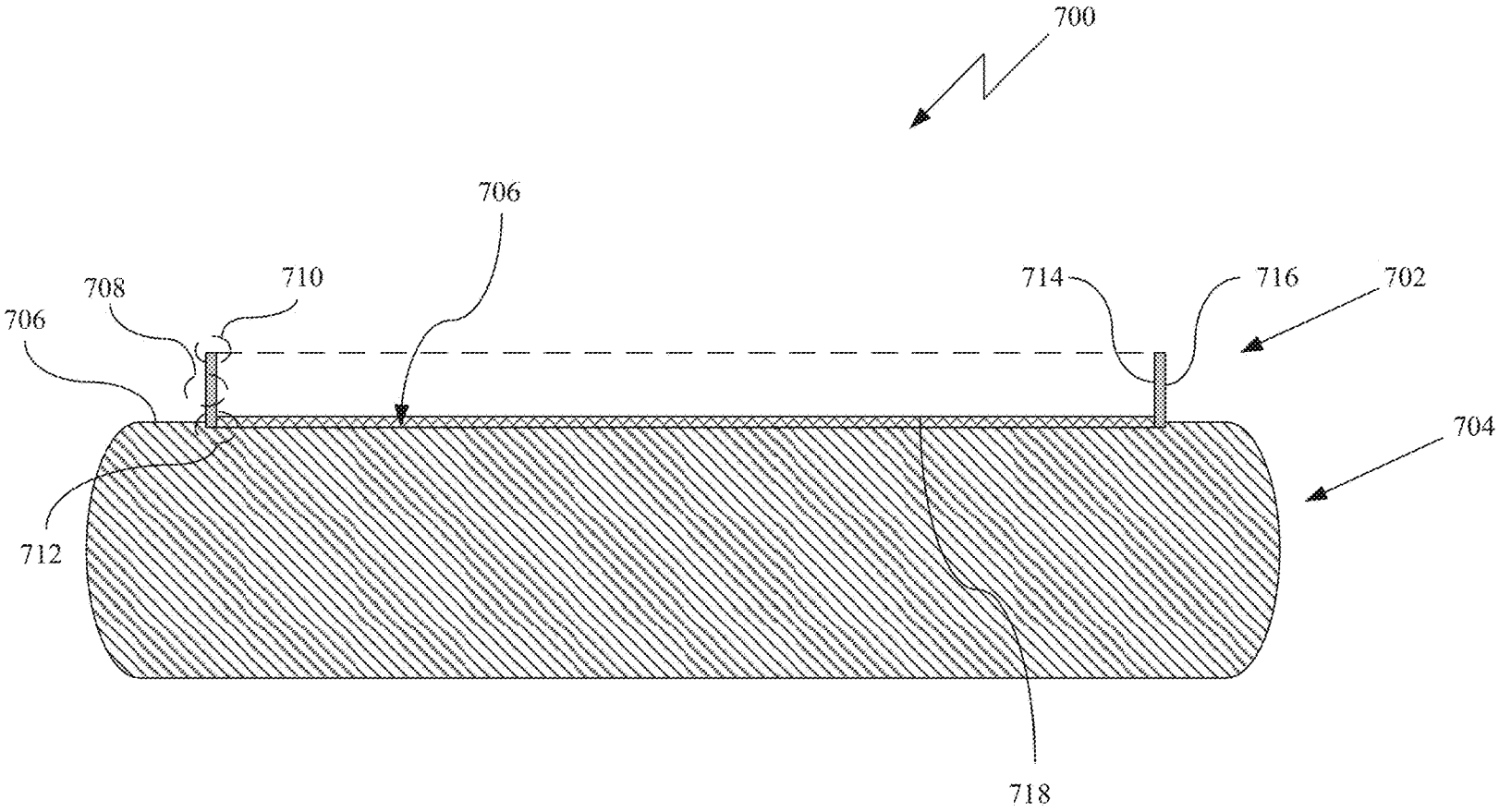
FIG. 7 is a side view of still another example of an implementation of a BPCS in accordance with the invention.

In FIG. 6, a side view of another example of an implementation of a BPCS 600 is shown in accordance with the invention. The BPCS 600 may include a centering ring 602 and a buffing pad 604. The centering ring 602 is attached to the back surface 606 of the buffing pad 604. The centering ring 602 may have a cylindrical vertical member 608 and a top boundary 610 and a bottom boundary 612 where the cylindrical vertical member 608 extends between the top boundary 610 and bottom boundary 612. The cylindrical vertical member 608 may include an inner cylindrical surface 614 and an outer cylindrical surface 616. The inner cylindrical surface 614 is capable of snuggly receiving a back plate (not shown). The centering ring 602 includes a bottom projecting member 618, wherein the bottom projecting member 618 projects out from the outer cylindrical surface 616 of the cylindrical vertical member 608 at approximately 90 degrees to form an outer bottom ledge 618.

It is appreciated that the front surface (not shown) of the back plate is attached to the back surface 606 of the buffing pad 604 utilizing an attaching means 620. The attaching means 620 may be a hook-and-loop fabric. Additionally, it is also appreciated that the bottom projecting member 618 may be attached to the back surface 606 utilizing adhesive. Similar to FIG. 5, the hook-and-loop fabric 620, in FIG. 6, may be attached to the back surface 606 utilizing adhesive. As an example, a loop-side fabric of the hook-and-loop fabric 620 may be bonded to the back surface 606, while a hook-side fabric (not shown) of the hook-and-loop fabric 620 may be bonded to the front surface of the back plate, or vise-versa.

In FIG. 7, a side view of yet another example of an implementation of a BPCS 700 is shown in accordance with the invention. The BPCS 700 may include a centering ring 702 and a buffing pad 704. The centering ring 702 is attached to the back surface 706 of the buffing pad 704. The centering ring 702 may have a cylindrical vertical member 708 and a top boundary 710 and a bottom boundary 712 where the cylindrical vertical member 708 extends between the top boundary 710 and bottom boundary 712. The cylindrical vertical member 708 may include an inner cylindrical surface 714 and an outer cylindrical surface 716. The inner cylindrical surface 714 is capable of snuggly receiving a back plate (not shown).

Again, it is appreciated that the front surface (not shown) of the back plate is attached to the back surface 706 of the buffing pad 704 utilizing an attaching means 718. The attaching means 718 may be a hook-and-loop fabric. Additionally, it is also appreciated that the bottom boundary 712 of the centering ring 702 may be attached to the back surface 706 utilizing adhesive. Similarly, the hook-and-loop fabric 718, in may be attached to the back surface 706 utilizing adhesive. As an example, a loop-side fabric of the hook-and-loop fabric 718 may be bonded to the back surface 706, while a hook-side fabric (not shown) of the hook-and-loop fabric 718 may be bonded to the front surface of the back plate, or vise-versa.

Figure 8:
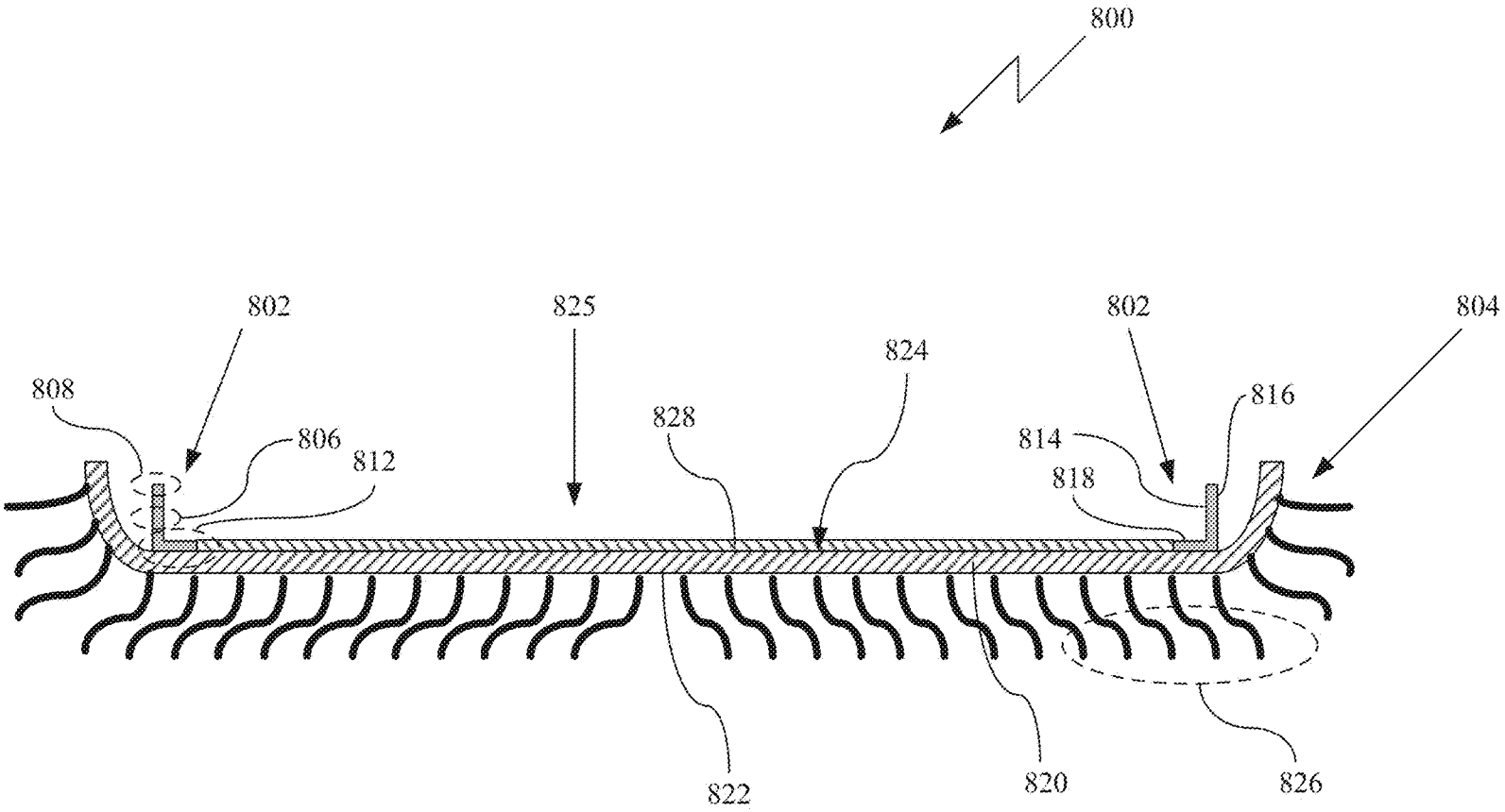
FIG. 8 is a side view of another example of an implementation of a BPCS in accordance with the invention.

In FIG. 8, a side view of an example of an implementation of a BPCS 800 is shown in accordance with the invention. The BPCS 800 may include a centering ring 802 and a buffing pad 804.

Similar to the centering ring 204 described in FIGS. 2A through 2C, the centering ring 802 may have a cylindrical vertical member 806 and a top boundary 808 and a bottom boundary 810 where the cylindrical vertical member 806 extends between the top boundary 808 and bottom boundary 810. The cylindrical vertical member 806 may include an inner cylindrical surface 814 and an outer cylindrical surface 816. The inner cylindrical surface 814 is capable of snuggly receiving a back plate (not shown). The centering ring 802 includes a bottom projecting member 818, wherein the bottom projecting member 818 projects out from the inner cylindrical surface 814 of the cylindrical vertical member 808 at approximately 90 degrees to form an inner bottom ledge 818 that is capable of supporting the edge of the back plate (not shown).

The buffing pad 804 may include a rigid back member 820, front surface 822, and back surface 824. The rigid back member 820 may be constructed of a rigid material such as, for example, plastic, epoxy resin, polyurethane, or other structurally rigid material. The back surface 824 may be curved upward to form a cavity 825. A soft material 826 may be attached to the front surface 822 of the buffing pad 804. Examples of the soft material 826 may include, for example, wool or cloth.

The bottom projecting member 818 of the centering ring 802 may be attached to the back surface 824 of the buffing pad 804. Additionally, an attaching means 828 may be attached to the back surface 824 to allow the buffing pad 804 to attach to the front face (not shown) of the back plate (not shown). As an example, the attaching means 828 may be a hook-and-loop fabric.

It is appreciated that the bottom projecting member 818 may be attached to the back surface 824 utilizing adhesive. Similarly, the hook-and-loop fabric 828 maybe be attached to both the front surface of the back plate and back surface 824 of the buffing pad 804 utilizing adhesive. As an example, the attaching means 828 may be a loop-side fabric of the hook-and-loop fabric that may be bonded to the back surface 824, while a hook-side fabric (not shown) may be bonded to the front surface of the back plate.

Figure 9:
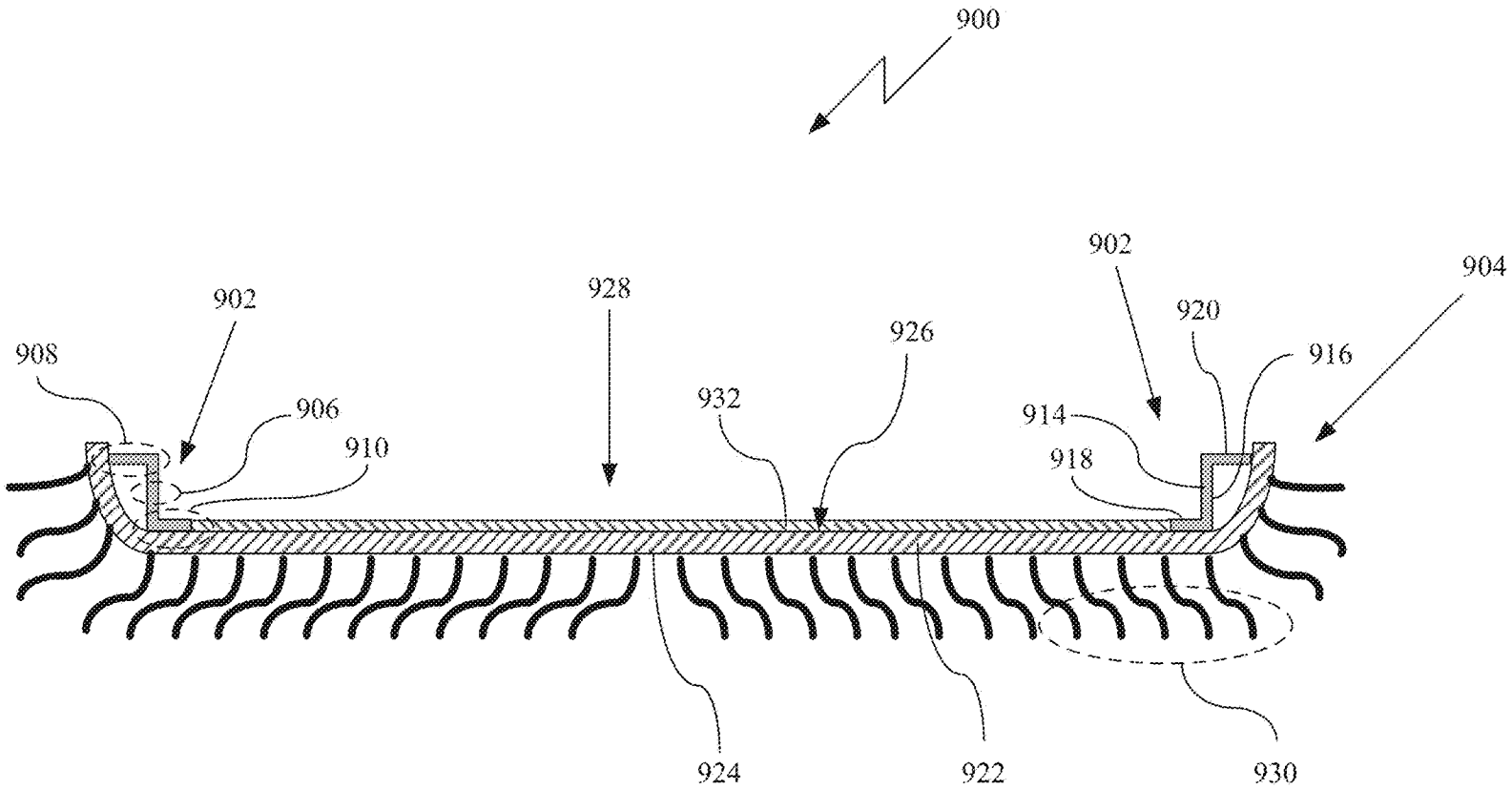
FIG. 9 is a side view of yet another example of an implementation of a BPCS in accordance with the invention.

In FIG. 9, a side view of another example of an implementation of a BPCS 900 is shown in accordance with the invention. The BPCS 900 may include a centering ring 902 and a buffing pad 904.

Similar to the centering ring 304 described in FIGS. 3A through 3C, the centering ring 902 may have a cylindrical vertical member 906 and a top boundary 908 and a bottom boundary 910 where the cylindrical vertical member 906 extends between the top boundary 908 and bottom boundary 910. The cylindrical vertical member 906 may include an inner cylindrical surface 914 and an outer cylindrical surface 916. The inner cylindrical surface 914 is capable of snuggly receiving a back plate (not shown). The centering ring 902 includes a bottom projecting member 918, wherein the bottom projecting member 918 projects out from the inner cylindrical surface 914 of the cylindrical vertical member 908 at approximately 90 degrees to form an inner bottom ledge 918 that is capable of supporting the edge of the back plate (not shown). Additionally, the centering ring 902 also includes a top projecting member 920, wherein the top projecting member 920 projects out from the outer cylindrical surface 916 of the cylindrical vertical member 908 at approximately 90 degrees to form a top ledge 920 that may, as an example, rest against the inside of buffing pad 904.

The buffing pad 904 may include a rigid back member 922, front surface 924, and back surface 926. The rigid back member 922 may be constructed of a rigid material such as, for example, plastic, epoxy resin, polyurethane, or other structurally rigid material. The back surface 926 may be curved upward to form a cavity 928. A soft material 930 may be attached to the front surface 924 of the buffing pad 904. Examples of the soft material 930 may include, for example, wool or cloth.

The bottom projecting member 918 of the centering ring 902 may be attached to the back surface 926 of the buffing pad 904. Additionally, an attaching means 932 may be attached to the back surface 926 to allow the buffing pad 904 to attach to the front face (not shown) of the back plate (not shown). As an example, the attaching means 932 may be a hook-and-loop fabric.

It is also appreciated that the bottom projecting member 918 may be attached to the back surface 926 utilizing adhesive. Similarly, the hook-and-loop fabric 932 maybe be attached to both the front surface of the back plate and back surface 926 of the buffing pad 904 utilizing adhesive. As an example, the attaching means 932 may be a loop-side fabric of the hook-and-loop fabric that may be bonded to the back surface 926, while a hook-side fabric (not shown) may be bonded to the front surface of the back plate.

Figure 10:
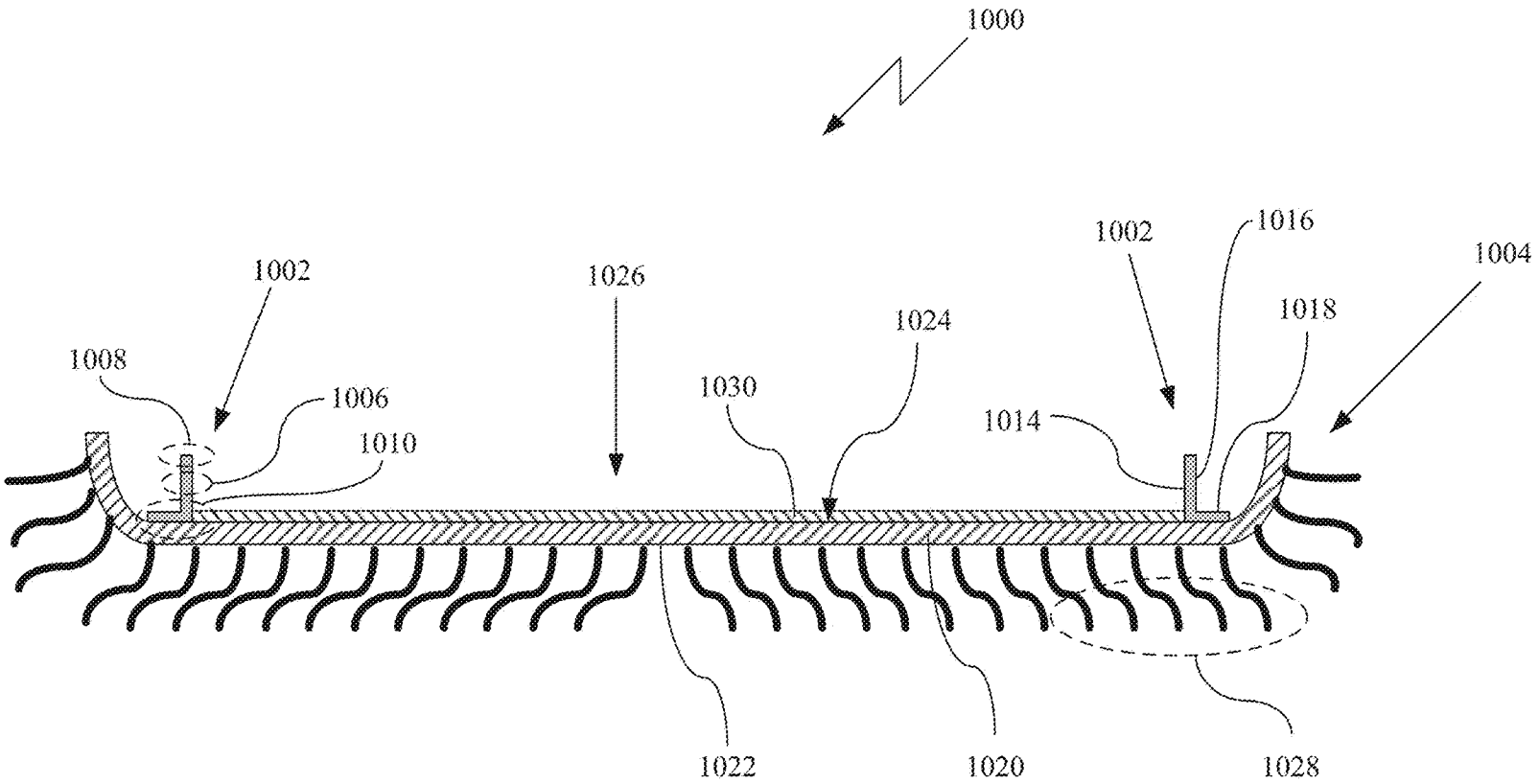
FIG. 10 is a side view of still another example of an implementation of a BPCS in accordance with the invention.

In FIG. 10, a side view of yet another example of an implementation of a BPCS 1000 is shown in accordance with the invention. The BPCS 1000 may include a centering ring 1002 and a buffing pad 1004.

Similar to the centering ring 602 described in FIG. 6, the centering ring 1002 may have a cylindrical vertical member 1006 and a top boundary 1008 and a bottom boundary 1010 where the cylindrical vertical member 1006 extends between the top boundary 1008 and bottom boundary 1010. The cylindrical vertical member 1006 may include an inner cylindrical surface 1014 and an outer cylindrical surface 1016. The inner cylindrical surface 1014 is capable of snuggly receiving a back plate (not shown). The centering ring 1002 includes a bottom projecting member 1018, wherein the bottom projecting member 1018 projects out from the outer cylindrical surface 1016 of the cylindrical vertical member 1006 at approximately 90 degrees to form an inner bottom ledge 1018.

The buffing pad 1004 may include a rigid back member 1020, front surface 1022, and back surface 1024. The rigid back member 1020 may be constructed of a rigid material such as, for example, plastic, epoxy resin, polyurethane, or other structurally rigid material. The back surface 1024 may be curved upward to form a cavity 1026. A soft material 1028 may be attached to the front surface 1022 of the buffing pad 1004. Examples of the soft material may include, for example, wool or cloth.

The bottom projecting member 1018 of the centering ring 1002 may be attached to the back surface 1024 of the buffing pad 1004. Additionally, an attaching means 1030 may be attached to the back surface 1024 to allow the buffing pad 1004 to attach to the front face (not shown) of the back plate (not shown). As an example, the attaching means 1030 may be a hook-and-loop fabric.

As described above in earlier examples, it is again appreciated that the bottom projecting member 1018 may be attached to the back surface 1024 utilizing adhesive. Similarly, the hook-and-loop fabric 1030 maybe be attached to both the front surface of the back plate and back surface 1024 of the buffing pad 1004 utilizing adhesive. As an example, the attaching means 1030 may be a loop-side fabric of the hook-and-loop fabric that may be bonded to the back surface 1024, while a hook-side fabric (not shown) may be bonded to the front surface of the back plate.

Figure 11:
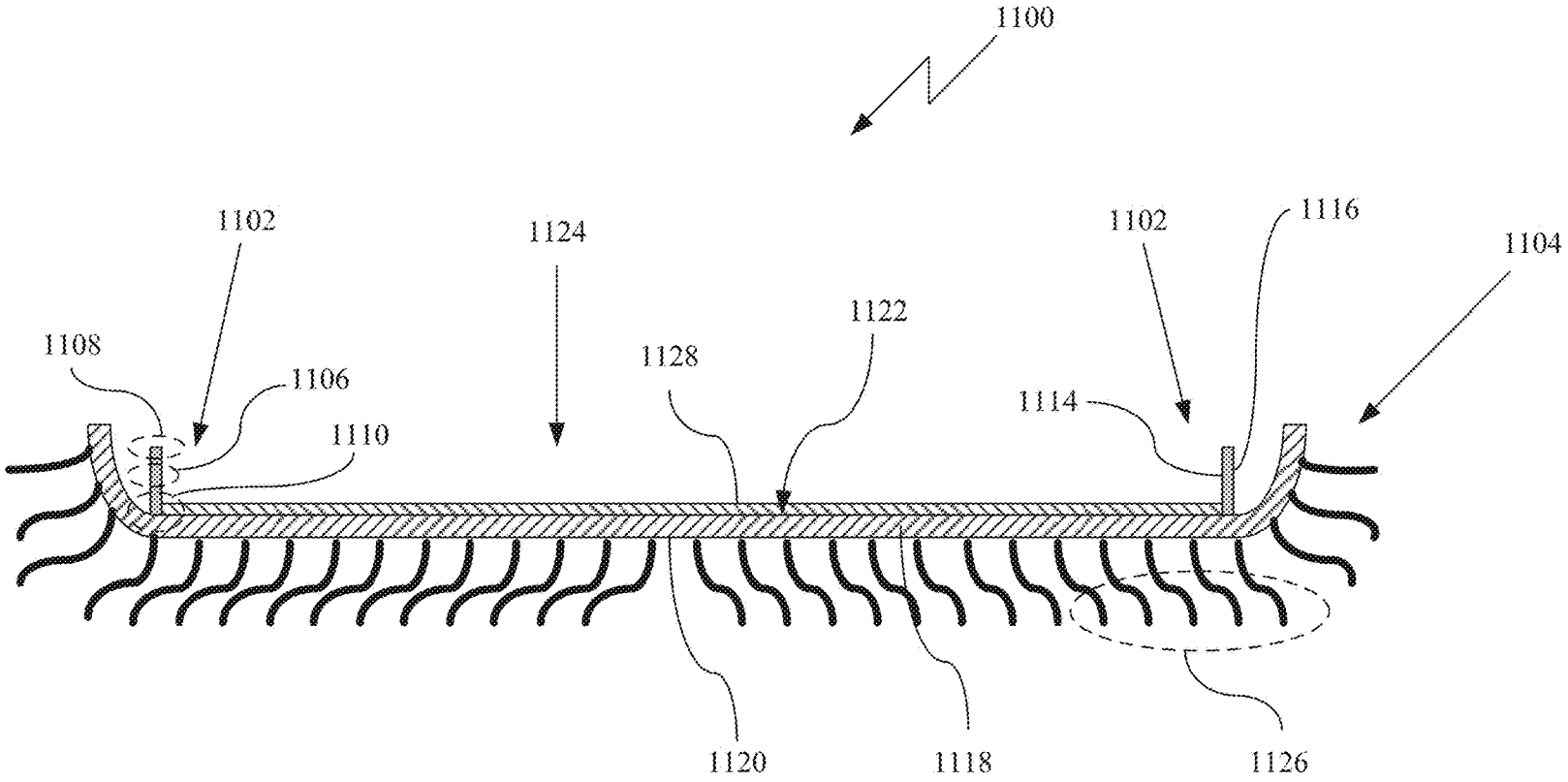
FIG. 11 is a side view of another example of an implementation of a BPCS in accordance with the invention.

In FIG. 11, a side view of another example of an implementation of a BPCS 1100 is shown in accordance with the invention. The BPCS 1100 may include a centering ring 1102 and a buffing pad 1104.

Similar to the centering ring 702 described in FIG. 7, the centering ring 1102 may have a cylindrical vertical member 1106 and a top boundary 1108 and a bottom boundary 1110 where the cylindrical vertical member 1106 extends between the top boundary 1108 and bottom boundary 1110. The cylindrical vertical member 1106 may include an inner cylindrical surface 1114 and an outer cylindrical surface 1116. The inner cylindrical surface 1114 is capable of snuggly receiving a back plate (not shown).

The buffing pad 1104 may include a rigid back member 1118, front surface 1120, and back surface 1122. The rigid back member 1118 may be constructed of a rigid material such as, for example, plastic, epoxy resin, polyurethane, or other structurally rigid material. The back surface 1122 may be curved upward to form a cavity 1124. A soft material 1126 may be attached to the front surface 1120 of the buffing pad 1104. Examples of the soft material 1126 may include, for example, wool or cloth.

The bottom boundary 1110 of the centering ring 1102 may be attached to the back surface 1122 of the buffing pad 1104. Additionally, an attaching means 1128 may be attached to the back surface 1122 to allow the buffing pad 1104 to attach to the front face (not shown) of the back plate (not shown). As an example, the attaching means 1128 may be a hook-and-loop fabric.

It is also appreciated that the bottom boundary 1110 may be attached to the back surface 1122 utilizing adhesive. Similarly, the hook-and-loop fabric 1128 maybe be attached to both the front surface of the back plate and back surface 1124 of the buffing pad 1104 utilizing adhesive. As an example, the attaching means 1128 may be a loop-side fabric of the hook-and-loop fabric that may be bonded to the back surface 1124, while a hook-side fabric (not shown) may be bonded to the front surface of the back plate.

Figure 12:
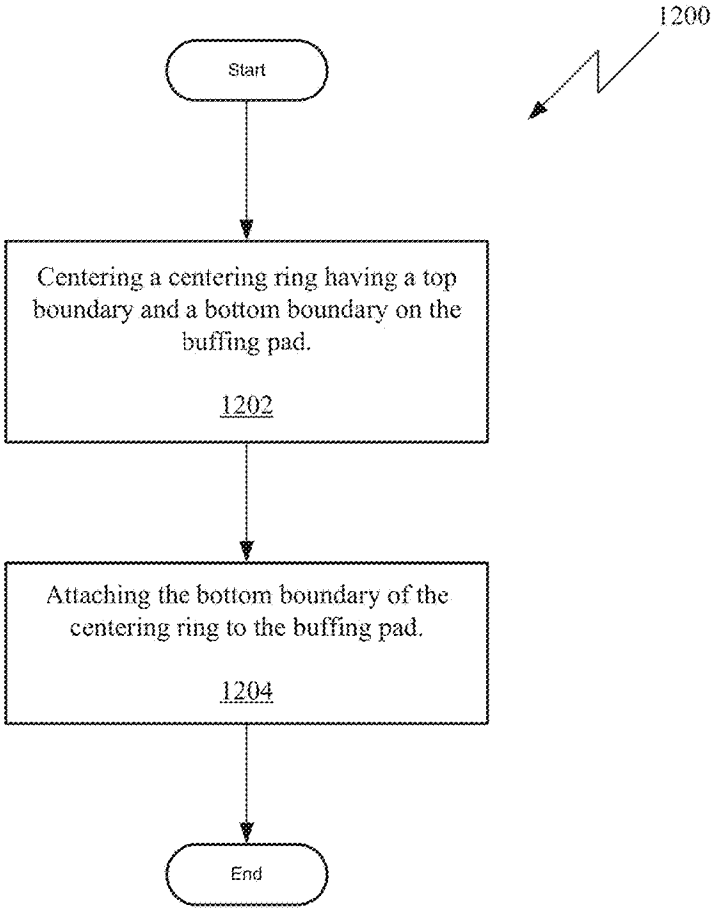
FIG. 12 is a flowchart that illustrates an example process in fabricating the BPCS shown in FIGS. 2A through 11.

In FIG. 12, a flowchart 1200 that illustrates an example process in fabricating the BPCS shown in FIGS. 2A through 11 is shown in accordance with the invention. The method may include the steps of 1202 centering a centering ring having a top boundary and a bottom boundary on the buffing pad and 1204 attaching the bottom boundary of the centering ring to the buffing pad.

In this example process, the centering ring may include a cylindrical vertical member extending between the top boundary and bottom boundary and the cylindrical vertical member may have an inner cylindrical surface and an outer cylindrical surface. Additionally, the inner cylindrical surface is capable of snuggly receiving the back plate.

As another example process of fabricating the BPCS shown in FIGS. 2A through 4C, the buffing pad (such as buffing pads 206, 306, and 406) may have a recessed pocket cut out of the back surface (such as back surfaces 230, 332, and 428) of the buffing pad to create a cavity (such as cavities 238, 338, and 438) having a cavity diameter. An attaching means (such as a fabric of hook-and-loop fasteners) may be bonded into the bottom (i.e., inner surface) of the cavity (such as at inner surfaces 232, 334, and 430) wall to wall (for example, from one part of the inner wall surfaces 234, 336, and 432 to another). The centering ring (such as centering rings 204, 304, and 404) is placed into the cavity where the centering ring precisely fits into the diameter of the cavity. The centering ring may be attached to the inner surface of cavity with an adhesive or other bonding method. A rotation device, such as a plate (which may be similar to a backing plate), may be placed into the centering ring with a precision fit within the inner surfaces (such as inner cylindrical surfaces 222, 322, and 422) of the centering ring. The rotation device is configured to connect to a motor that may rotate the rotation device at a predetermined rotation rate (such as, for example 20 to 30 rotations per minute). The predetermined rotation rate may be chosen based on the material of the buffing pad, cutting and/or grinding technology, or other factors. The rotation device will allow the motor to accurately rotate the buffing pad. A grinding stone that spins and/or cutting tool is then placed in contact with the outer diameter of the buffing pad so as to trimming the outside diameter of the buffing pad (herein known as "edge correcting"). This grinding stone and/or cutting tool may correct the centering ring from being off center, relative to the buffing pad, when it was attached to the inner surface of cavity by creating a buffing pad outside diameter that is concentric with the centering ring.

While the present invention has been described with reference to certain embodiments, it will be understood by those skilled in the art that various changes can be made and equivalents can be substituted without departing from the scope of the present invention. It will be understood that the foregoing description of an implementation has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

The invention claimed is:

1. A Buffing Pad Centering System ("BPCS") for centering a back plate having an edge and a front surface, said BPCS comprising:

a centering ring having a top boundary and a bottom boundary, said centering ring including a vertical member extending between said top boundary and said bottom boundary, wherein said vertical member has at least an inner cylindrical surface capable of snuggly receiving and centering said back plate; and a buffing pad that includes a frontside and a backside, said frontside of said buffing pad being substantially flat and said backside of said buffing pad including a recess, said recess having a top boundary and a bottom boundary defining a cavity on said backside of said buffing pad;

wherein said centering ring is placed within and affixed to said cavity, thereby resulting in said centering ring being both secured within said cavity and centered on said buffing pad.

2. The BPCS of claim 1, wherein said bottom boundary of said centering ring includes a bottom projecting member, wherein said bottom projecting member projects out from said inner cylindrical surface of said vertical member at approximately 90 degrees to form an inner bottom ledge that is capable of supporting said edge of said back plate.

3. The BPCS of claim 2, wherein said affixion is accomplished using adhesive between at least said bottom projecting member and a horizontal bottom of said cavity.

4. The BPCS of claim 1, wherein said top boundary of said centering ring includes a top projecting member, wherein said top projecting member projects out from an outer surface of said vertical member at approximately 90 degrees.

5. The BPCS of claim 1, wherein said affixion is accomplished using adhesive between at least said vertical member and a vertical side of said cavity.

6. The BPCS of claim 1, wherein said front surface of said back plate has a first attached hook-and-loop fabric, and at least a portion of a horizontal bottom of said cavity has a second attached hook-and-loop fabric for attaching to the first attached hook-and-loop fabric.

7. The BPCS of claim 1, wherein said centering ring is constructed from a material selected from a group consisting of metal, plastic, wood, epoxy resin, and polyurethane.

8. The BPCS of claim 1, wherein said buffing pad is constructed from a material selected from a group consisting of foam, plastic, polyurethane, cloth, and wool.

9. The BPCS of claim 1, wherein a vertical side of said cavity snuggly receives said vertical member of said centering ring.

10. A buffing pad centering system, comprising:

a buffing pad having a frontside and a backside, said frontside having a substantially flat surface for buffing or polishing a vehicle, and said back side having a recess with a top boundary and a bottom boundary defining a cavity on said backside of said buffing pad; and a centering ring having at least a vertical member with a cylindrical inner surface, said centering ring being disposed within said cavity and secured to said buffing pad, thereby substantially centering said centering ring on said backside of said buffing pad; and wherein said centering ring is configured to receive a back plate, an outer circumference of said back plate being positioned inside said centering ring and against said cylindrical inner surface, thereby substantially centering said back plate on said backside of said buffing pad.

11. The system of claim 10, wherein said centering ring is disposed within said cavity so that said vertical member is against a vertical side of said cavity.

12. The system of claim 11, wherein said centering ring is secured to said buffing pad using adhesive between at least said vertical member and said vertical side of said cavity.

13. The system of claim 10, wherein said centering ring further comprises a horizontal member positioned adjacent a horizontal bottom of said cavity.

14. The system of claim 13, wherein said centering ring is secured to said buffing pad using adhesive between at least said horizontal member and said horizontal bottom of said cavity.

15. The system of claim 10, wherein said back plate is secured to said buffing pad centering system via a first hook-and-loop fabric on said system and a second hook-and-loop fabric on said back plate.

16. The system of claim 15, wherein said first hook-and-loop fabric is affixed to at least a portion of a horizontal bottom of said cavity.

17. The system of claim 10, wherein said centering ring is disposed within said cavity so that said vertical member is against a horizontal bottom of said cavity.

18. A method for manufacturing a buffing pad centering system, comprising:

creating a cavity on a backside of a buffing pad, said cavity comprising a top boundary and a bottom boundary and a vertical surface therebetween; and disposing a centering ring within said cavity, said centering ring having at least a vertical member with a cylindrical inner surface and being secured to said buffing pad, thereby substantially centering said centering ring on said backside of said buffing pad;

wherein said centering ring is configured to receive a back plate, said back plate being disposed within said centering ring so that an outer circumference of said back plate is against said cylindrical inner surface, thereby substantially centering said back plate on said backside of said buffing pad.

19. The method of claim 18, wherein said centering ring further comprises a horizontal member, said centering ring being secured to said buffing pad using adhesive between at least one of (1) said vertical member and a vertical side of said cavity and (2) said horizontal member and horizontal bottom of said cavity.

20. The method of claim 18, wherein said method further comprises affixing a first hook-and-loop material to at least a portion of a horizontal bottom of said cavity, said back plate having a second hook-and-loop material configured to mate with said first hook-and-loop material within said cavity.

* * * * *